US010209038B2

(12) United States Patent
Wallace

(10) Patent No.: US 10,209,038 B2
(45) Date of Patent: Feb. 19, 2019

(54) ELECTRIFIED STUN CURTAIN

(71) Applicant: Christopher D. Wallace, Greer, SC (US)

(72) Inventor: Christopher D. Wallace, Greer, SC (US)

( * ) Notice: Subject to any disclaimer, the term of this patent is extended or adjusted under 35 U.S.C. 154(b) by 208 days.

(21) Appl. No.: 15/222,117

(22) Filed: Jul. 28, 2016

(65) Prior Publication Data

US 2017/0074622 A1 Mar. 16, 2017

Related U.S. Application Data

(60) Provisional application No. 62/217,160, filed on Sep. 11, 2015.

(51) Int. Cl.

| | |
|---|---|
| ***H01T 23/00*** | (2006.01) |
| ***F41H 13/00*** | (2006.01) |
| ***E06B 9/08*** | (2006.01) |
| ***E06B 9/06*** | (2006.01) |
| *F41H 5/08* | (2006.01) |

(52) U.S. Cl.

CPC ..... *F41H 13/0018* (2013.01); *E06B 9/0638* (2013.01); *E06B 9/0669* (2013.01); *E06B 9/08* (2013.01); *F41H 5/08* (2013.01)

(58) Field of Classification Search

CPC ..... F41H 13/0018

See application file for complete search history.

(56) References Cited

U.S. PATENT DOCUMENTS

| | | | | |
|---|---|---|---|---|
| 4,025,359 | A * | 5/1977 | Connelly, Jr. | C23G 1/06 134/22.14 |
| 6,404,613 | B1 | 6/2002 | Dowling et al. | |
| 8,107,213 | B2 | 1/2012 | Smith | |
| 8,441,771 | B2 | 5/2013 | Heinz | |
| 9,018,868 | B2 | 4/2015 | Lucas et al. | |
| 2007/0133146 | A1 | 6/2007 | Nerheim | |
| 2013/0229745 | A1* | 9/2013 | Unterlack | F41H 13/0018 361/232 |

* cited by examiner

*Primary Examiner* — Stephen W Jackson

(74) *Attorney, Agent, or Firm* — J. Bennett Mullinax, LLC

(57) ABSTRACT

A curtain of a flexible fabric is provided that is deployable to create a physical and visual barrier between an employee and a person perpetuating a crime such as a robbery or assault. The barrier can be in the form of a curtain that is electrified with an extreme high voltage, similar to a stun gun, and which prevents the assailant from approaching an employee or a restricted area. The curtain can be mounted in any area where it is beneficial to limit site and access of a trespasser or an assailant, such as between a cashier at a convenience store and the store's open retail area. The curtain can also be used to create temporary safe rooms or deployed within hallways of a restricted area to limit movement of an intruder.

18 Claims, 4 Drawing Sheets

ELECTRIFIED STUN CURTAIN

RELATED APPLICATIONS

This application claims the benefit of U.S. Provisional Application No. 62/217,160 filed on Sep. 11, 2015 and which is incorporated herein by reference.

FIELD OF THE INVENTION

This invention is directed towards a curtain of a flexible fabric that is deployable to create a physical and visual barrier between an employee and a person perpetuating a crime such as a robbery or assault. The barrier can be in the form of a curtain that is electrified with an extreme high voltage, similar to a stun gun, and which prevents the assailant from approaching an employee or a restricted area. The curtain can be mounted in any area where it is beneficial to limit site and access of a trespasser or an assailant, such as between a cashier at a convenience store and the store's open retail area The curtain can also be used to create temporary safe rooms or deployed within hallways of a restricted area to limit movement of an intruder in commercial and residential environments.

BACKGROUND OF THE INVENTION

This invention relates generally to technology used to incapacitate an individual using high voltage. It is well know in the art to provide stun guns which either use an electrode mounted on a hand-held device or an electrode that is fired as a projectile onto an assailant. In either case, contact with the conductors by an assailant will typically incapacitate the assailant.

Heretofore, the use of an incapacitating level of electricity has been limited to hand-held devices such as a Taser® or hand deployed devices such as a stun gun or an electrified stun shield used as a riot shield for crowd control. While such devices are useful for their intended purposes, there remains a need for ways to use a high voltage deterrent to prevent access or entry to a region and to also provide a visual and physical barrier as a way of protecting an individual from an assailant.

Accordingly, there remains room for improvement and variation within the art.

SUMMARY OF THE INVENTION

It is one aspect of at least one of the present embodiments to provide for a deployable, drop down security curtain having a plurality of electrical conductors adapted for conducting a high frequency, high voltage output when discharged.

It is a further aspect of at least one of the present embodiments of the current invention to provide for a security curtain having a plurality of spaced electrical conductors and at least one pair of electrodes, the electrodes facilitating the periodic discharge to protect the electronics associated with the security curtain.

It is a further aspect of at least one embodiment of the present invention to provide for a security curtain having a plurality of spaced electrical conductors which are rapidly deployable from an overhead housing, the housing being optionally positioned within a space above a drop down ceiling.

It is a further aspect of at least one embodiment of the present invention to provide for a security curtain which is operatively engaged with a high speed electric motor to rapidly deploy the curtain in an emergency situation.

It is a further aspect of at least one embodiment of the present invention to provide for a deployable security curtain that can be activated by a least one of a manual switch, a remote control, or the triggering of a security alarm.

It is a further aspect of at least one embodiment of the present invention to provide for multiple high voltage security curtains to be released simultaneously.

It is a further aspect of at least one embodiment of the present invention to provide for a high voltage security curtain having a circuit which periodically pulses the high voltage electricity and output to the conductors on the curtain.

It is a further aspect of at least one embodiment of the present invention to provide for a deployable electrified security curtain having a plurality of conductors which is released on activation of a monitored security alarm system.

It is a further aspect of at least one embodiment of the present invention to provide for a protective barrier comprising: a panel of a flexible material that is capable of being rolled or folded; a plurality of electrical conductors extending along a surface of the panel, the conductors in communication with a high frequency and high voltage electrical output source; a least two electrodes spaced along an edge of the panel and in communication with the electrical output source, the spaced electrodes providing a spark gap; wherein when a high frequency and high voltage electrical current is applied to the plurality of electrical conductors, the panel is capable of rendering a high voltage discharge when contacted by a person. The protective barrier may have the electrical conductors are spaced apart a distance of about 8 inches or less and more preferably the electrical conductors are spaced apart a distance of substantially about 6 inches.

The protective barrier electrical input may be source is powered by 115V AC. The panel is stored on a roller and may be deployed from a housing.

It is a further aspect of at least one embodiment of the present invention to provide for a protective barrier wherein the roller carrying the panel is responsive to a motor to deploy the panel.

It is a further aspect of at least one embodiment of the present invention to provide for a protective barrier has a high voltage output source pulsed at an interval of about 1 second.

It is a further aspect of at least one embodiment of the present invention to provide for a protective barrier wherein the motor used to deploy the panel is responsive to a manually activated switch.

It is a further aspect of at least one embodiment of the present invention to provide for a protective barrier wherein the high voltage source is supplied to the electrical conductors only when the panel is fully deployed.

It is a further aspect of at least one embodiment of the present invention to provide for a protective barrier wherein the panel of flexible material is released from a housing and is deployed by gravity.

It is a further aspect of at least one embodiment of the present invention to provide for a protective barrier according wherein a bottom portion of the panel is attached to a weighted rod.

It is a further aspect of at least one embodiment of the present invention to provide for a process of providing an electrical security curtain comprising: supplying a flexible panel, the panel comprising the plurality of spaced conductors and further comprising at least one pair of electrodes in communication with the conductors; deploying the flexible panel from a compact stored position to a deployed position upon activation of a switch; providing a high frequency and high voltage electric current to the conductors when the flexible panel is in a fully deployed state, thereby providing a panel having an electrified surface that provides for a barrier against intruders.

It is a further aspect of at least one embodiment of the present invention to provide for a process wherein the flexible panel is deployed in response to an intruder alarm.

It is a further aspect of at least one embodiment of the present invention to provide for a process wherein the step of deploying the flexible panel further comprises using a motorized roller to deploy the panel.

It is a further aspect of at least one embodiment of the present invention to provide for a process wherein the deploying step further includes allowing the panel to be released and deployed in response to gravity.

It is a further aspect of at least one embodiment of the present invention to provide for a process wherein lateral side walls of the panel are contained within guide rails to facilitate the deployment of the panel.

It is a further aspect of at least one embodiment of the present invention to provide for a process wherein the flexible panel further comprises a material selected from the group consisting of fabric, Keylar®, PVC, Tyvek®, vinyl, plastic, metal mesh, and accordion constructed sub panels.

It is a further aspect of at least one embodiment of the present invention to provide for a process wherein an additional step includes locking the panel in place when the panel is fully deployed.

These and other aspects of the invention can be seen in reference to the drawings and description set forth below.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure, is not repeated in the descriptions of subsequent figures, although such apparatus or process is labeled with the same reference numbers.

Figure 1:
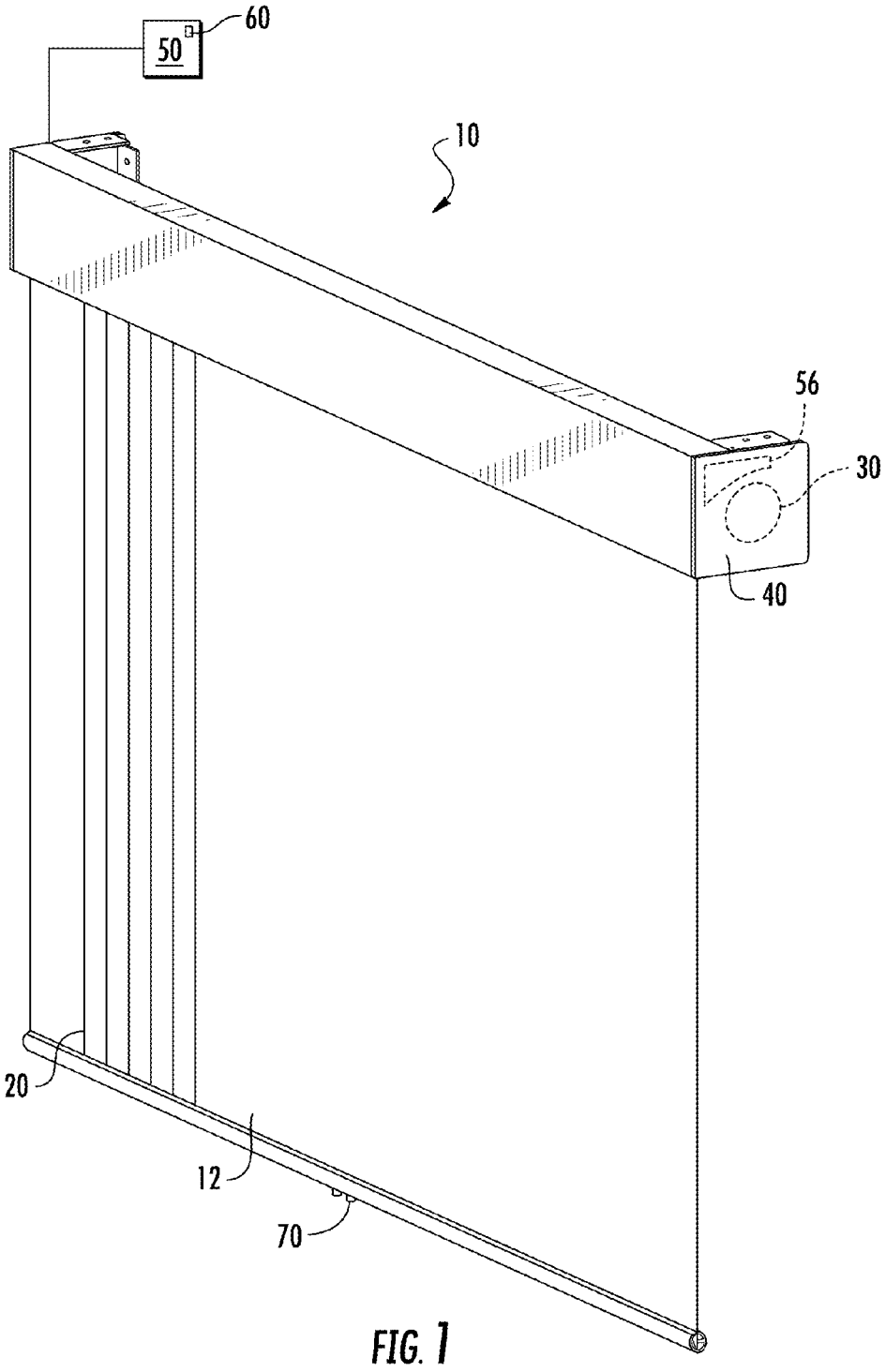
FIG. 1 is a perspective view of an electrified security curtain as seen in accordance with the present invention and disclosure.

As seen in reference to FIG. 1, a stun curtain 10 is provided which is designed to create a physical and visual barrier between an individual, such as an employee and a criminal or trespasser who may be trying to harm the individual or commit a potentially violent criminal act. The barrier is in form of a curtain that is electrified with high voltage conductors 20 using technology similar to a stun gun. When deployed, the electrified curtain prevents a robber or trespasser from passing through the curtain without receiving a debilitating high voltage shock. The deployment of the curtain also provides the employee an opportunity to reach safety or take other defensive measures to protect themselves and property.

As seen in reference to FIG. 1, the stun curtain 10 consist of a large panel 12 that may be of heavy duty vinyl, PVC, fabric, Tyvex®, Keyler® or similar material that can be mounted on a rod 30 and rolled into a rectangular housing 40, Multi-layer curtains can also be provided which can provide for combinations of a vinyl with Kevlar® material. The housing 40 can be mounted to the ceiling, suspended from the ceiling, or placed within a space above a drop down ceiling to be deployed through a small opening provided in the ceiling. In any of the embodiments of the curtain, the housing 40 may provide an opening along substantially the entire width of the housing and may optionally be covered by a brush seal from which the curtain is lowered when activated. The stun curtain can be made in any length that is needed for a particular application though it is envisioned that standard widths of between 6 to 10 feet are desirable and that the preferred deployment is from a ceiling height or mounting height of 12 feet or less. However, the height and width can be customized for any specific need including adjustments to the motorized deployment mechanism in order to rapidly deploy the curtain within any customized environment. One suitable housing and motorized deployment and retraction mechanism can be seen in reference to U.S. Pat. No. 9,018,868 directed to a projection screen system. The teachings in reference of U.S. Pat. No. 9,018,868 is hereby incorporated herein by reference.

Each stun curtain is in communication with a control box 50 which is mounted within reach of an employee where an employee may interact with customers. Each control box has an emergency activation switch 60, and may be responsive to an optional remote control, and manual up/down controls and LED indicators showing that the power supply is available and that the system is ready for activation. The electric motor 56 can rapidly deploy a curtain from an 8 to 12 foot ceiling in about 2 seconds. If needed, multiple curtains can be mounted in series to provide an effective width of protection that may be needed by the user. Where multiple curtains are utilized, the electrical systems may be intermittent such that the first curtain supplies the electrical power for the additional curtains. As each curtain emerges the activation circuits can be linked together so that activation of any single curtain will bring about activation of all the stun curtains at the same time.

For either a single curtain or multiple curtain deployments, any number of control boxes with emergency activation switches can be placed in areas convenient for an employee or user. An emergency activation switch can also be provided through a fob device that an employee or user can carry with them. In this way, the employee can activate the stun curtain if not able to immediately access a positioned or mounted permanent switch.

The fabric which forms the stun curtain may be attached to a roll up door material such as accordion type steel door or a metal mesh security screen that is commonly used outside of business doors and windows. Such screens could have the fabric attached to a surface of the metal door material or alternatively the electrodes could be attached and secured to the metal substrate. In such embodiments, the roll up type doors can be automatically deployed using conventional motors and release mechanisms. One advantage of these embodiments are that the metal components provides additional security to an employee since an intruder would be unable to physically breach the reinforced curtain.

To assist with the rapid deployment of the curtain in any of the described and illustrated embodiments, guide rails can be provided along either width of the curtain or a portion of the curtain so as to more rapidly deploy the curtain in an emergency situation. The rail system can use conventional rollers such as those seen in lightweight garage door use. In addition to a more rapid deployment, the track or rail system provides additional security in that it is more difficult to pass through the curtain contained within the tracks or guide rails than a simple gravity drop down curtain.

Using a series of guide rails along the edges of the electrified curtain also allows for a possible latching mechanism to be deployed along the bottom of the curtain such that the curtain will latch or lock to a surface to provide additional security. The locking mechanism can be of any number of appropriate engagement mechanisms including mechanical catches or latches that grip a bottom portion of the curtain. The bottom of the curtain could have a metal or other structural rod which is designed to engage a security latch. Further, a steel rod or similar element in the bottom of the curtain could engage a strong electromagnet where the bottom of the curtain reaches a surface such as a counter or display area. In this embodiment, the electromagnet would only be engaged when the curtain is activated to prevent magnetic forces from interfering with consumer devices or magnetic strips on credit cards.

Each curtain has lengths of copper wire or a similar electrical conductors 20 running vertically along the entire length of the curtain and are spaced approximately 6 inches apart. In addition to copper wire, wire braids, conductors of other metals, and similar materials can be used as conductors with respect to the conductors seen in FIG. 1. While the conductors 20 seen in FIG. 1 are oriented in substantially a vertical direction and spaced apart, it is possible to provide for a square or rectangular pattern of both horizontal and vertical conductors. It is has been found that a 6-8 inch spacing is adequate to prevent an intruder from being able to touch or manipulate the curtain without at least 2 conductors being touched, creating the high frequency high voltage output which incapacitates the individual. As a result, the electrified curtain provides an effective barrier between an employee and a robber/trespasser so that a person coming in contact with the curtain will experience pain and temporary incapacitation including involuntary muscle contractions. The high voltage utilized is capable of penetrating typical gloves and multiple fabric clothing layers.

Along the bottom of each curtain, two electrodes 70 are present which are spaced apart so as to provide for a spark gap. The spark gap conducts the high voltage when the curtain is activated in the emergency mode and not in contact with a person. The periodic discharge is necessary to protect the electronics of the high voltage circuit. The high voltage discharge has the additional benefit of creating a loud noise in a deterring effect as the curtain is being lowered and continues as the curtain is fully deployed. The high voltage discharge is characterized by loud cracking electrical sounds and creates bright sparks in the air gap between the electrodes. When the curtain is touched by a person, the high voltage electricity is conducted through the person's body rather than being discharged through the electrodes.

Figure 2:
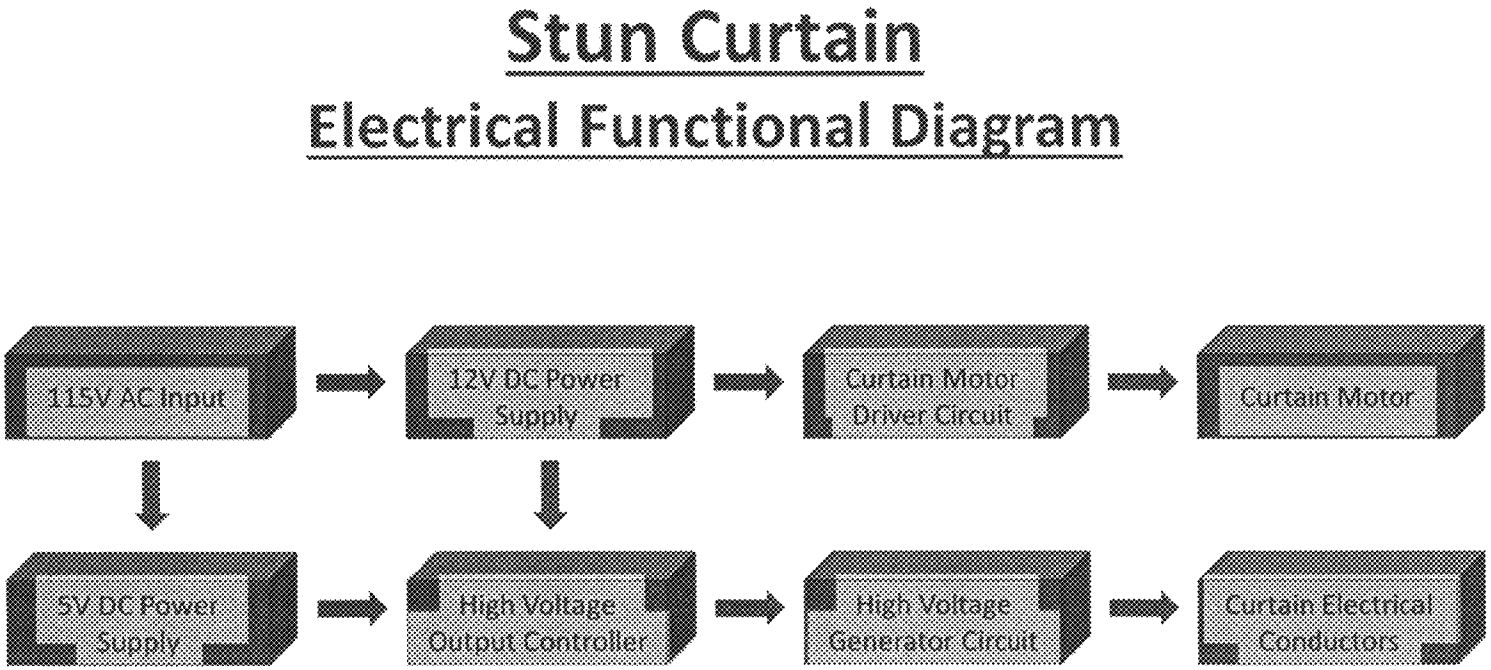
FIG. 2 is a flow chart diagram setting forth components for use with a security curtain.

As seen in reference to FIG. 2, the electronics for the stun curtain can be powered by standard 115V AC and can be plugged directly into a standard electrical outlet. The circuitry for the high voltage needed for the stun curtain is similar to that used for hand-held stun gun devices and weapons that shoot a projectile designed to incapacitate the individual. Reference to such technology is made with respect to U.S. Pat. No. 8,441,771 entitled "Electronic Weaponry with Current Spreading Electrode" and U.S. Pat. No. 8,107,213 entitled "Systems and Methods for Immobilization Using Pulse Series" and U.S. Pat. No. 6,404,613 entitled "Animal Stun Gun" all of which are incorporated herein by reference. The circuitry can also be adapted to accept 230 and 240 volt applications that are used in other countries. Inside the housing that contains the stun curtain, a 115 volt AC power supply is used to provide for a 12 volt DC and a 5 volt DC power supply that operates the entire device. The curtain utilizes an adjustable 2 speed DC motor drive circuit to operate the motor to raise and lower the curtain. The high speed setting is for an automatic "emergency" deployment. The low speed manual curtain movement is for retraction and non-emergency testing for deployment of the equipment.

Figure 3:
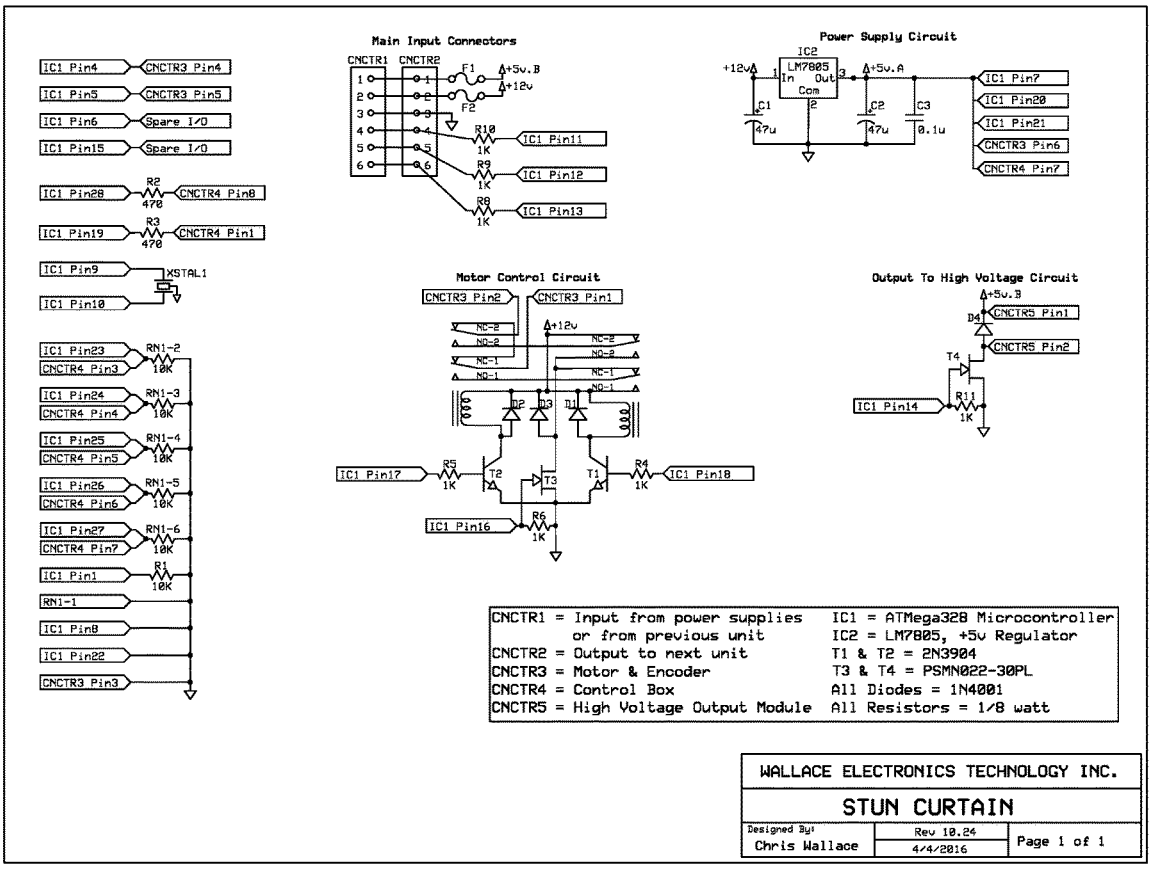
FIGS. 3 and 4 are schematic diagrams of the electronic components that may be utilized in an electrified security curtain.
Figure 4:
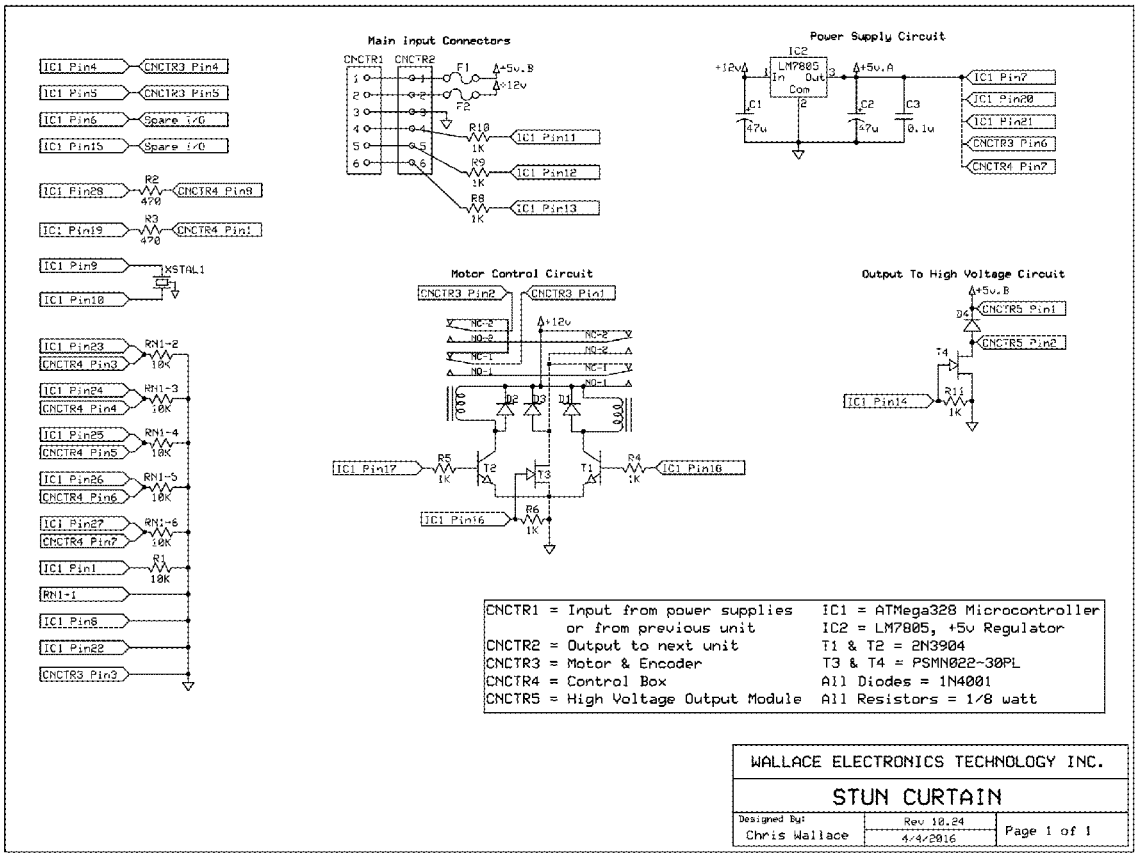

As seen in reference to FIGS. 3 and 4, limit switch circuits may be used to stop the motor during deployment and to assist with retraction of the curtain. One circuit senses when the curtain is fully deployed and one senses when the curtain is fully retracted. Alternatively, a motor with an encoder and motor position detecting software can be utilized to control the activation of the electrical circuitry. Upon activation of an emergency release button, the high speed driver circuit is activated to lower the curtain. When the manual up/down circuit is activated, the stun curtain utilizes the low speed circuit and during the manual movement, the high voltage circuit is not activated. The manual movement is used only to raise and lower the curtain for testing and inspection and to retract it after the emergency circuit has been activated and then deactivated. For safety, the curtain can not be retracted with the high voltage circuit activated. The user must engage the emergency button before the curtain can be retracted. Alternatively, the control of the raising and lowering of the stun curtain can be controlled by software which will control the motor speed then can use a lower speed to raise the curtain and use a more rapid deployment speed when releasing the curtain for activation.

In accordance with the present invention, it has been found useful to employ a timer circuit that is responsive to the high voltage output and as seen in reference to FIGS. 3 and 4. The circuit is designed to apply a pulsed output at 1 second intervals to supply the high voltage electricity to the conductors on the curtain. The pulsed output helps prevent the high voltage circuit from damaging the electronics of the curtain.

Upon deployment of the curtain, there could be an optional audible alarm which sounds and which can further disorient or distressipanic a trespasser or criminal who is suddenly confronted with a loud alarm noise, visual sparks from the curtain, and an audible spark discharge noise from the curtain.

The curtain is useful for placement in convenience stores to provide a level of protection between an employee and members of the public. When threatened, an employee can rapidly deploy the stun curtain which will prevent the robber from reaching or coming over the counter. In addition, the curtain provides a visual barrier such that the employee can safely move to a more secure location.

While certain descriptions herein are given in reference to a business environment of an employee and an intruder or unruly customer, the technology is equally useful for use in a home environment to secure an area within the home from an intruder.

Upon activation of the drop down curtain, a number of optional security features can also be deployed. For instance, the operator can have an option of manually activating loud audible alarms with sufficiently high decibels that can create disorientation and panic in an assailant. The stun curtain can also trigger the release of various safety products such as a pepper spray to further discourage or incapacitate an assailant. These audible or chemical deterrent can be deployed automatically upon activating the curtain.

While the preferred embodiment of the invention is described with respect to a drop down curtain, the present invention can also be supplied in the form of a motorized deployable fabric curtain which is engaged laterally across a support rod or structure. For instance, by either a motorized or manual engagement of a stun fabric or curtain across a horizontal support rod, activation of the curtain can occur upon the deployment or closing of the curtain. Various sensors could be used to detect when a curtain is manually drawn. A motorized version of a laterally moving stun curtain can also be used, if manually deployed, an insulated handle or rod can be provided to allow a user to safely deploy the stun curtain without risking contact with the activated electrified curtain.

For vertically deployed curtains, a weighted bottom can be applied to the curtain to help facilitate rapid deployment of the curtain. It is envisioned that for some applications, a weighted curtain bottom can be used to bring about a "free fall" deployment of the curtain using gravity in such an embodiment, the motor and rod would be utilized solely to retract the curtain for storage. As discussed earlier, the weighted rod could be of an iron material or have dimensions such that it can be used with a mechanical or electromagnetic latching system to attach the curtain to a surface following deployment.

The stun curtain can be deployed in a variety of commercial and residential applications. For instance, employees can retreat during an emergency situation to a restroom or other closed environment in which the entrance to the door way is further protected by a drop down stun curtain. This provides additional protection and creates a "safe room" environment when needed. The stun curtain can be used with institutions such as schools and businesses if ever faced in an emergency lock down mode. The curtain can help seal entrances to a class room, block off hallways, or stairwell doors, during an emergency condition.

In a similar manner, the stun curtain can be used in residential applications to create a temporary safe room environment that would prevent or greatly impede a trespasser gaining access into a room. The time delay provides a greater opportunity for law enforcement officials to respond to an emergency call.

Other useful environments include prisons where multiple stun curtains can be deployed along corridors, stairwells, and hallways to limit access during an emergency situation such as a riot or a mass escape attempt. The stun curtains are also suitable for use in other high security need areas such as court houses, court rooms, and other secure locations.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention as set forth herein. In addition, it should be understood that aspects of the various embodiments may be interchanged, both in whole, or in part. Therefore, the spirit and scope of the invention should not be limited to the description of the preferred versions contained therein.

That which is claimed:

1. A protective barrier comprising;

a panel of a flexible material that is stored within a housing;

a plurality of electrical conductors extending along a surface of the panel, the conductors in communication with a high frequency and high voltage electrical output source;

at least two electrodes spaced along an edge of the panel and in communication with the electrical output source, the spaced electrodes providing a spark gap;

wherein when the flexible material is deployed from the housing, a high frequency and high voltage electrical current is applied to the plurality of electrical conductors, and the panel is capable of rendering a high voltage discharge when contacted by a person.

2. The protective barrier according to claim 1 wherein the electrical conductors are spaced apart a distance of about 8 inches or less.

3. The protective barrier according to claim 1 wherein the electrical conductors are spaced apart a distance of substantially about 6 inches.

4. The protective barrier according to claim 1 wherein the electrical output source is powered by a 115V AC input.

5. The protective barrier according to claim 1 wherein the panel is stored on a roller within the housing.

6. The protective barrier according to claim 5 wherein the roller is responsive to a motor to deploy the panel.

7. The protective barrier according to claim 1 wherein the high voltage output source is pulsed at an interval of about 1 second.

8. The protective barrier according to claim 6 wherein the motor used to deploy the panel is responsive to a manually activated switch.

9. The protective barrier according to claim 1 wherein the high voltage source is supplied to the electrical conductors only when the panel is fully deployed.

10. The protective barrier according to claim 1 wherein the panel of flexible material is released from the housing and is deployed by gravity.

11. The protective barrier according to claim 1 wherein a bottom portion of the panel is attached to a weighted rod.

12. A process of providing an electrical security curtain comprising:

supplying a flexible panel, the panel comprising the plurality of spaced conductors and further comprising at least one pair of electrodes in communication with the conductors;

deploying the flexible panel from a compact stored position to a deployed position upon activation of a switch;

providing a high frequency and high voltage electric current to the conductors when the flexible panel is in a fully deployed state, thereby providing a panel having an electrified surface that provides for a barrier against intruders.

13. The process according to claim 12 wherein the flexible panel is deployed in response to an intruder alarm.

14. The process according to claim 12 wherein the step of deploying the flexible panel further comprises using a motorized roller to deploy the panel.

15. The process according to claim 12 wherein the deploying step further includes allowing the panel to be released and deployed in response to gravity.

16. The process according to claim 14 wherein lateral side walls of the panel are contained within guide rails to facilitate the deployment of the panel.

17. The process according to claim 12 wherein the flexible panel further comprises a material selected from the group consisting of fabric, Kevlar®, PVC, Tyvek®, vinyl, plastic, metal mesh, and accordion constructed sub panels.

18. The process according to claim 12 wherein an additional step includes locking the panel in place when the panel is fully deployed.

* * * * *